US009001143B2

(12) United States Patent
Felt

(10) Patent No.: US 9,001,143 B2
(45) Date of Patent: Apr. 7, 2015

(54) COLOR MAPPING

(75) Inventor: Michelle Felt, Randolph, NJ (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 241 days.

(21) Appl. No.: 13/190,663

(22) Filed: Jul. 26, 2011

(65) Prior Publication Data

US 2013/0027420 A1 Jan. 31, 2013

(51) Int. Cl.
*G09G 5/02* (2006.01)

(52) U.S. Cl.
CPC ..... *G09G 5/028* (2013.01); *G09G 2320/0666* (2013.01); *G09G 2370/02* (2013.01); *G09G 2370/022* (2013.01)

(58) Field of Classification Search
None
See application file for complete search history.

(56) References Cited

U.S. PATENT DOCUMENTS

| | | | | |
|---|---|---|---|---|
| 6,784,905 | B2 * | 8/2004 | Brown et al. | 715/865 |
| 7,043,058 | B2 * | 5/2006 | Cornog et al. | 382/107 |
| 8,103,095 | B2 * | 1/2012 | Shirai | 382/167 |
| 2004/0085327 | A1 * | 5/2004 | Jones et al. | 345/591 |
| 2005/0129308 | A1 * | 6/2005 | Comfort et al. | 382/165 |
| 2005/0156942 | A1 * | 7/2005 | Jones | 345/589 |
| 2012/0147163 | A1 * | 6/2012 | Kaminsky | 348/62 |

OTHER PUBLICATIONS

Geary, David, "Graphic Java 2," vol. II: Swing, Third Edition, Prentice Hall, Mar. 12, 1999, p. 124.*

* cited by examiner

*Primary Examiner* — Hau Nguyen
*Assistant Examiner* — Ryan M Gray

(57) ABSTRACT

A method may include receiving, from a user, information identifying a first color, and identifying a first item having the first color to be output to a display. The method may also include generating information associated with the first item, the generated information including at least one of a pattern, text, a graphical symbol or an icon that will be used to identify the first color. The method may further include outputting the generated information to the display.

24 Claims, 12 Drawing Sheets

COLOR MAPPING

BACKGROUND INFORMATION

Many people are unable to distinguish differences in color. For example, people who are color blind are often unable to distinguish between red and green. As a result, such people are typically unable to get the full effect of information that is provided in color, such as information provided in color on a computer screen or other display device.

DETAILED DESCRIPTION OF PREFERRED EMBODIMENTS

The following detailed description refers to the accompanying drawings. The same reference numbers in different drawings may identify the same or similar elements. Also, the following detailed description does not limit the invention.

Implementations described herein provide color-related information to a party who may be color blind or have difficulty distinguishing various colors. In an exemplary implementation, a user may interact with a user device to select one or more colors of interest. The user device may also allow the user to select a particular manner in which he/she would like to have color-related information displayed. For example, the user may select a pattern to be overlaid on an item of a particular color, select graphical information that will be provided to identify the item having the particular color, and/or select text to be provided to identify the item having the particular color of interest. In some implementations, the user may select an item of interest provided on a display and be provided with color-related information associated with the item of interest.

Figure 1:
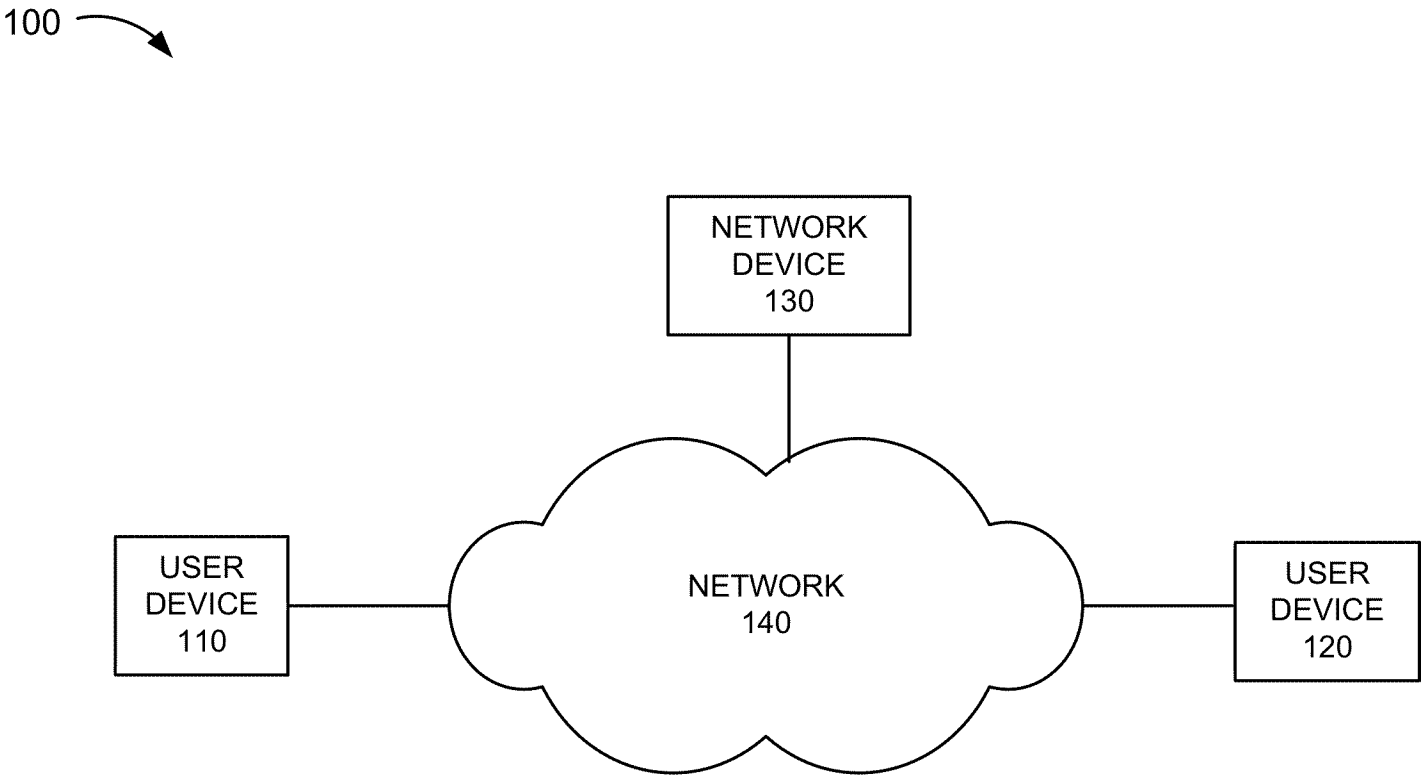
FIG. 1 illustrates an exemplary network in which systems and methods described herein may be implemented.

FIG. 1 is a block diagram of an exemplary network 100 in which systems and methods described herein may be implemented. Network 100 may include user device 110, user device 120, network device 130 and network 140.

User device 110 and/or user device 120 may each include any type of computer device or system, such as a personal computer (PC), a laptop, a tablet computer, a notebook, a netbook, etc., that may include a display. User device 110 and/or user device 120 may each also include a mobile device, such as wireless or cellular telephone device (e.g., a conventional cell phone with data processing capabilities), a smart phone, a personal digital assistant (PDA) that can include a radiotelephone, etc. User device 110 and/or user device 120 may also include a television and/or a set top box that receives television programming and outputs the programming to a display, monitor, etc.

Network device 130 may include one or more computing devices, servers and/or backend systems that are able to connect to network 140 and transmit and/or receive information via network 140. In one implementation, network device 130 may provide information to user devices 110 and 120 that may be output to users via a display. For example, network device 130 may be a server associated with a website that provides information to users via network 140.

Network 140 may include one or more wired, wireless and/or optical networks that are capable of receiving and transmitting data, voice and/or video signals. For example, network 140 may include one or more public switched telephone networks (PSTNs) or other type of switched network. Network 140 may also include one or more wireless networks and may include a number of transmission towers for receiving wireless signals and forwarding the wireless signals toward the intended destination. Network 140 may further include one or more satellite networks, one or more packet switched networks, such as an Internet protocol (IP) based network, a local area network (LAN), a wide area network (WAN), a personal area network (PAN), a WiFi network, an intranet, the Internet, or another type of network that is capable of transmitting data.

The exemplary configuration illustrated in FIG. 1 is provided for simplicity. It should be understood that a typical network may include more or fewer devices than illustrated in FIG. 1. For example, network 100, may include thousands of user devices and network devices. In addition, network 140 may include additional elements, such as switches, gateways, routers, etc., that aid in routing data.

Further, various functions are described below as being performed by particular components in network 100. In other implementations, various functions described as being performed by one device may be performed by another device or multiple other devices, and/or various functions described as being performed by multiple devices may be combined and performed by a single device.

Figure 2:
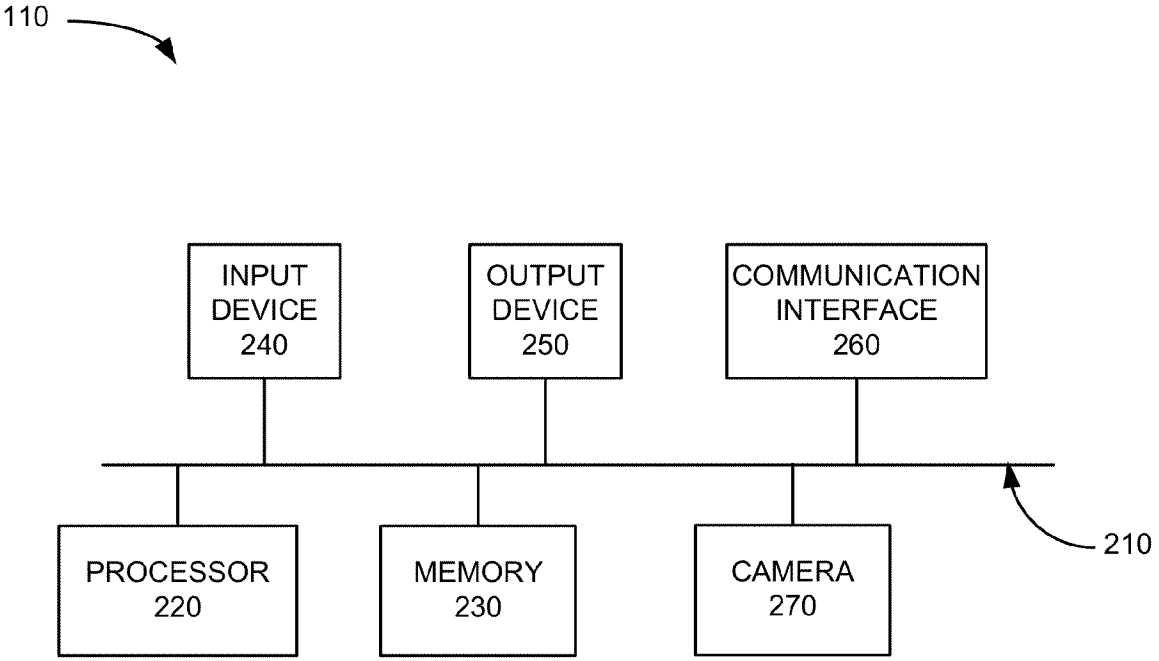
FIG. 2 illustrates an exemplary configuration of components implemented in one or more of the devices of FIG. 1.

FIG. 2 illustrates an exemplary configuration of user device 110. Other devices in network 100, such as user device 120 and network device 130 may be configured in a similar manner. Referring to FIG. 2, user device 110 may include bus 210, processor 220, memory 230, input device 240, output device 250, communication interface 260 and camera 270. Bus 210 may include a path that permits communication among the elements of user device 110.

Processor 220 may include one or more processors, microprocessors, or processing logic that may interpret and execute instructions. Memory 230 may include a random access memory (RAM) or another type of dynamic storage device that may store information and instructions for execution by processor 220. Memory 230 may also include a read only memory (ROM) device or another type of static storage device that may store static information and instructions for use by processor 220. Memory 230 may further include a solid state drive (SDD). Memory 230 may also include a magnetic and/or optical recording medium (e.g., a hard disk) and its corresponding drive.

Input device 240 may include a mechanism that permits a user to input information to user device 110, such as a key-board, a keypad, a mouse, a pen, a microphone, a touch screen, voice recognition and/or biometric mechanisms, etc. Output device 250 may include a mechanism that outputs information to the user, including a display (e.g., a liquid crystal display (LCD), a light-emitting diode (LED) based display, etc.), a printer, a speaker, etc.

Communication interface 260 may include a transceiver that user device 110 may use to communicate with other devices via wired, wireless or optical mechanisms. Communication interface 260 may also include one or more radio frequency (RF) transmitters, receivers and/or transceivers and one or more antennas for transmitting and receiving RF data via network 140. Communication interface 260 may also include a modem or an Ethernet interface to a LAN or other mechanisms for communicating with elements in a network, such as network 140 or another network.

Camera 270 may include components that allow user device 110 to capture still and/or moving images. Camera 270 may include a lens and shutter as well as other conventional camera elements used to capture images.

The exemplary configuration illustrated in FIG. 2 is provided for simplicity. It should be understood that user device 110 (user device 120 and/or network device 130) may include more or fewer devices than illustrated in FIG. 2. In an exemplary implementation, user device 110 may perform operations in response to processor 220 executing sequences of instructions contained in a computer-readable medium, such as memory 230. A computer-readable medium may be defined as a physical or logical memory device. The software instructions may be read into memory 230 from another computer-readable medium (e.g., a hard disk drive (HDD), SSD, etc.), or from another device via communication interface 260. Alternatively, hard-wired circuitry may be used in place of or in combination with software instructions to implement processes consistent with the implementations described herein. Thus, implementations described herein are not limited to any specific combination of hardware circuitry and software.

Figure 3:
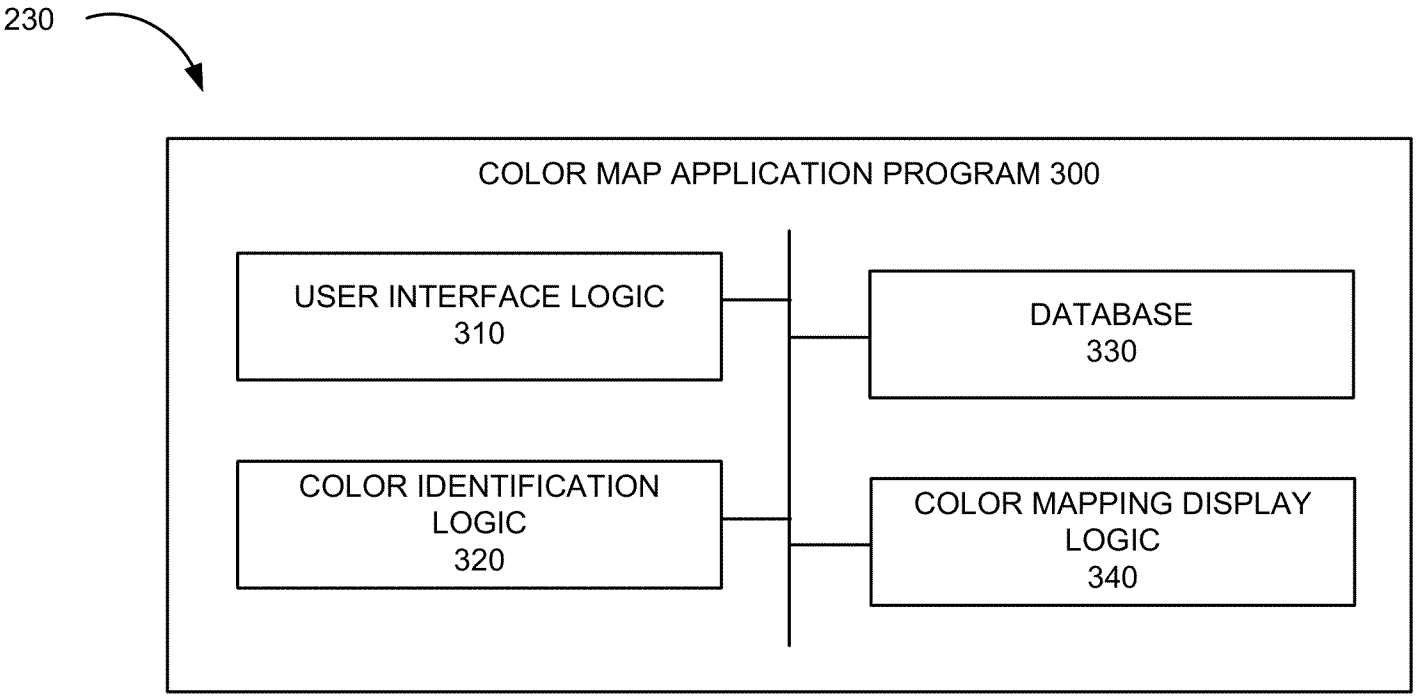
FIG. 3 illustrates an exemplary configuration of logic components implemented in the device of FIG. 2.

FIG. 3 is an exemplary functional block diagram of components implemented in user device 110 of FIG. 2. In an exemplary implementation, all or some of the components illustrated in FIG. 3 may be stored in memory 230. For example, referring to FIG. 3, memory 230 may include color map application program 300. Color map application program 300 may include software instructions executed by processor 220 that allows user device 110 to display information that identifies particular colors in a manner other than simply displaying the colors via output device 250.

Color map application program 300 may include user interface logic 310, color identification logic 320, database 330 and color mapping display logic 340. Color map application program 300 and its various logic components are shown in FIG. 3 as being included in memory 230 of user device 110. In alternative implementations, these components or a portion of these components may be located externally with respect to user device 110. For example, in some implementations, one or more of the components of color map application program 300 may be located in or executed by another device external to user device 110, such as in user device 120 and/or network device 130.

User interface logic 310 may include logic to provide a user with an interface to enter information associated with selecting color-related display parameters. For example, user interface logic 310 may include a graphical user interface (GUI) that allows a user to easily enter information to request that certain colors output via output device 250 of user device 110 be displayed in particular manners, such as with various patterns overlaid onto a particular color, with accompanying text located adjacent an item having the particular color, with pop-up graphical information identifying the particular color, or via other techniques, as described in detail below.

Color identification logic 320 may include logic associated with identifying colors to be output via output device 250. For example, color identification logic 320 may identify the red, green, blue (RGB) pixel values associated with colors of items to be provided via output device 250 (e.g., an LCD). This information may be used by color mapping display logic 340 to overlay patterns or provide other indicators associated with the selected color(s).

Database 330 may store user preference information. For example, database 330 may store the information provided via user interface logic 310 regarding user selected information. For example, in one implementation, database 330 may store information indicating the type of indicator(s) that a user would like displayed when particular colors are to be output. Database 330 may also store different user-defined types of color indication techniques based on the type of information to be displayed.

For example, the user may select via user interface logic 310 that certain types of information, such as static images, include one type of color indicator (e.g., a pattern overlaid on the selected color). The user may select via user interface logic 310 that other types of information, such as dynamically changing information (e.g., television programming, movies or streaming video) displayed by user device 110 include another type of color indicator, (e.g., temporary text or icons displayed adjacent the item having the selected color). Database 330 may store this information based on the user-defined preferences.

Color mapping display logic 340 may include logic to display color-related information in a manner that allows user who cannot distinguish various colors to identify the colors. For example, in one implementation, based on input from a user via user interface logic 310 and stored in database 330, color mapping display logic 340 may overlay one or more patterns over one or more selected colors that will be output via output device 250, such as an LCD or another type of display. As an example, color mapping display logic 340 may overlay a cross-hatch pattern over items that are associated with the color red, and overlay a dotted pattern over items that are associated with the color green, to allow the user to identify the colors red and green when he/she otherwise would be unable to recognize these colors.

As another example, in some implementations, color mapping display logic 340 may output pop-up information, such as text or graphical information that will be located adjacent or over the top of an item having a particular color to allow the user to quickly ascertain the color of the item, as described in more detail below.

Figure 4:
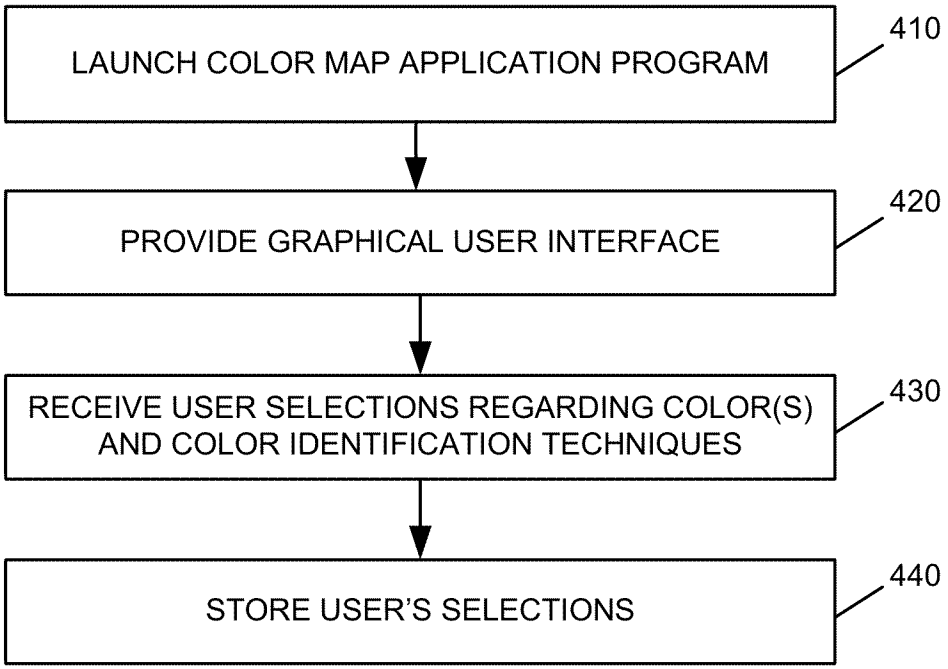
FIG. 4 is a flow diagram illustrating processing by logic components illustrated in FIG. 3 in accordance with an exemplary implementation.

FIG. 4 is a flow diagram illustrating exemplary processing associated with setting up display-related parameters via user device 110. In this example, assume that a party associated with user device 110 is color blind or partially color blind. Processing may begin with the party associated with user device 110 (referred to herein as the user) opening or launching color map application program 300 (block 410). For example, assume that user device 110 is a personal computer or laptop computer. The user may access a menu or user interface on user device 110 and open/run color map application program 300. After launching map application program 300, user interface logic 310 may provide a GUI that allows the user to provide information regarding his/her selections (block 420).

For example, the GUI may request whether the user would like to select one or more colors that he/she has difficulty with or is unable to distinguish. In this example, assume that the GUI includes a drop-down box/menu and the user selects the colors red and green (block 430). Next, the GUI may request that the user provide a particular manner in which he/she would like to have items in red and green that are to be output to the display (e.g., output device 250) highlighted, augmented and/or annotated. For example, the GUI may include a drop down menu that allows the user to select various types of patterns that may be overlaid on an object displayed in one of the selected colors. As an example, the user may select a cross-hatching pattern for the color red. The user may also select a dotted pattern for the color green. User interface logic 310 may receive the user's selections regarding the colors of interest and the techniques to highlight the selected colors (block 430). User interface logic 310 may also store this information in database 330 (block 440).

After the user has entered the desired information and map application program 300 has stored the user-selected information, color map application program 300 may be used to display images along with the selected overlays or other highlighting according to the user-defined preferences, as described in detail below.

Figure 5:
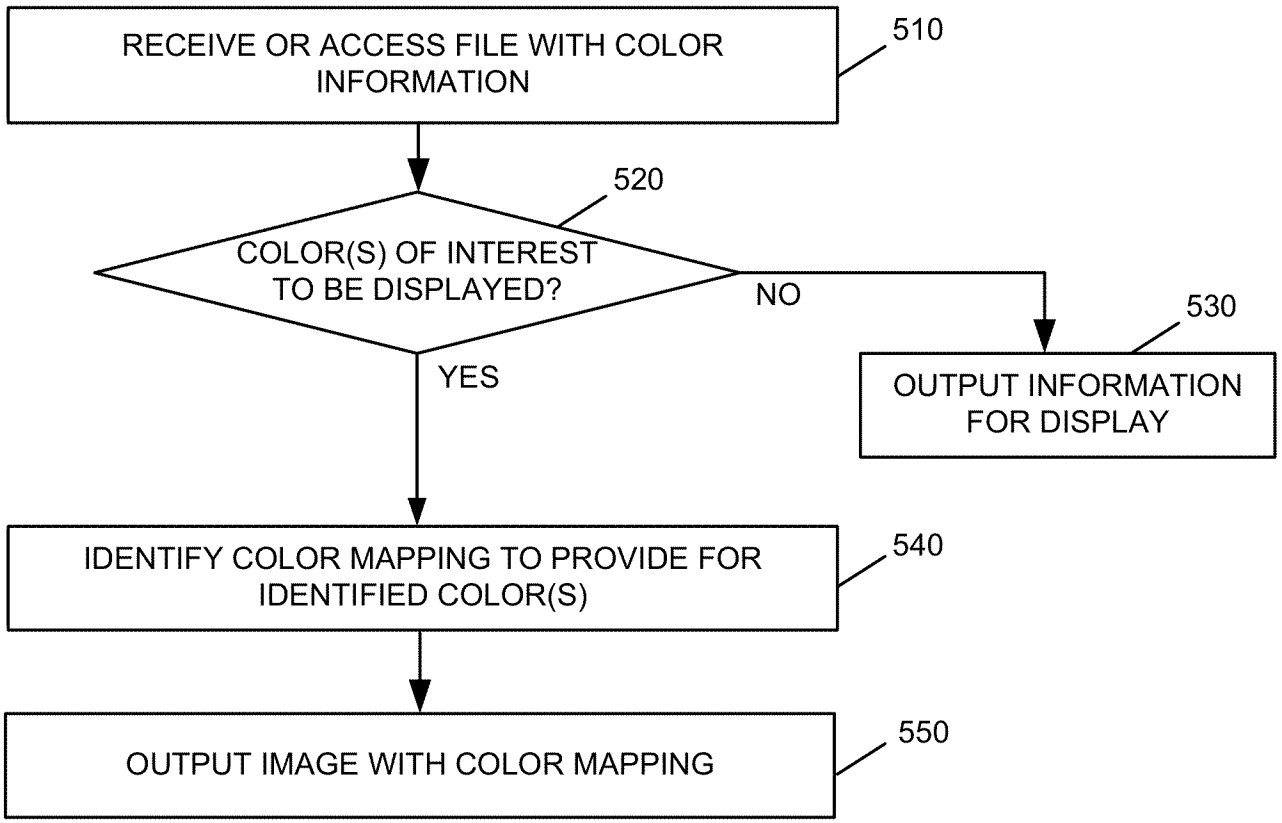
FIG. 5 is a flow diagram illustrating processing by components in the network of FIG. 1 in accordance with an exemplary implementation.

FIG. 5 illustrates exemplary processing associated with execution of color map application program 300. In this example, processing may begin with user device 110 receiving or accessing a file or information that includes color information (block 510). For example, user device 110 may receive a work-related file from a party at user device 120 via network 140. Map application program 300 may automatically launch or may be running as a background process that will be invoked when color information is to be displayed on user device 110. In either case, color identification logic 320 may determine whether the file to be output via output device 250 includes items having one or more of the colors selected by the user (block 520).

For example, continuing with the example above with respect to FIG. 4 in which the user selected red and green as being colors that he/she could not distinguish, color identification logic 320 may determine whether the file to be displayed includes either red or green items (e.g., images, objects and/or elements). If red or green is not included in items to be output (block 520—no), user device 110 may output the file via output device 250 for display without modification (block 530).

If, however, color identification logic 320 determines that red or green items are to be output for display, color identification logic 320 forwards this information to color mapping display logic 340. Color mapping display logic 320 may use the received information and access database 330 to identify the pattern or other information to be provided on the display (block 540).

Figure 6A:
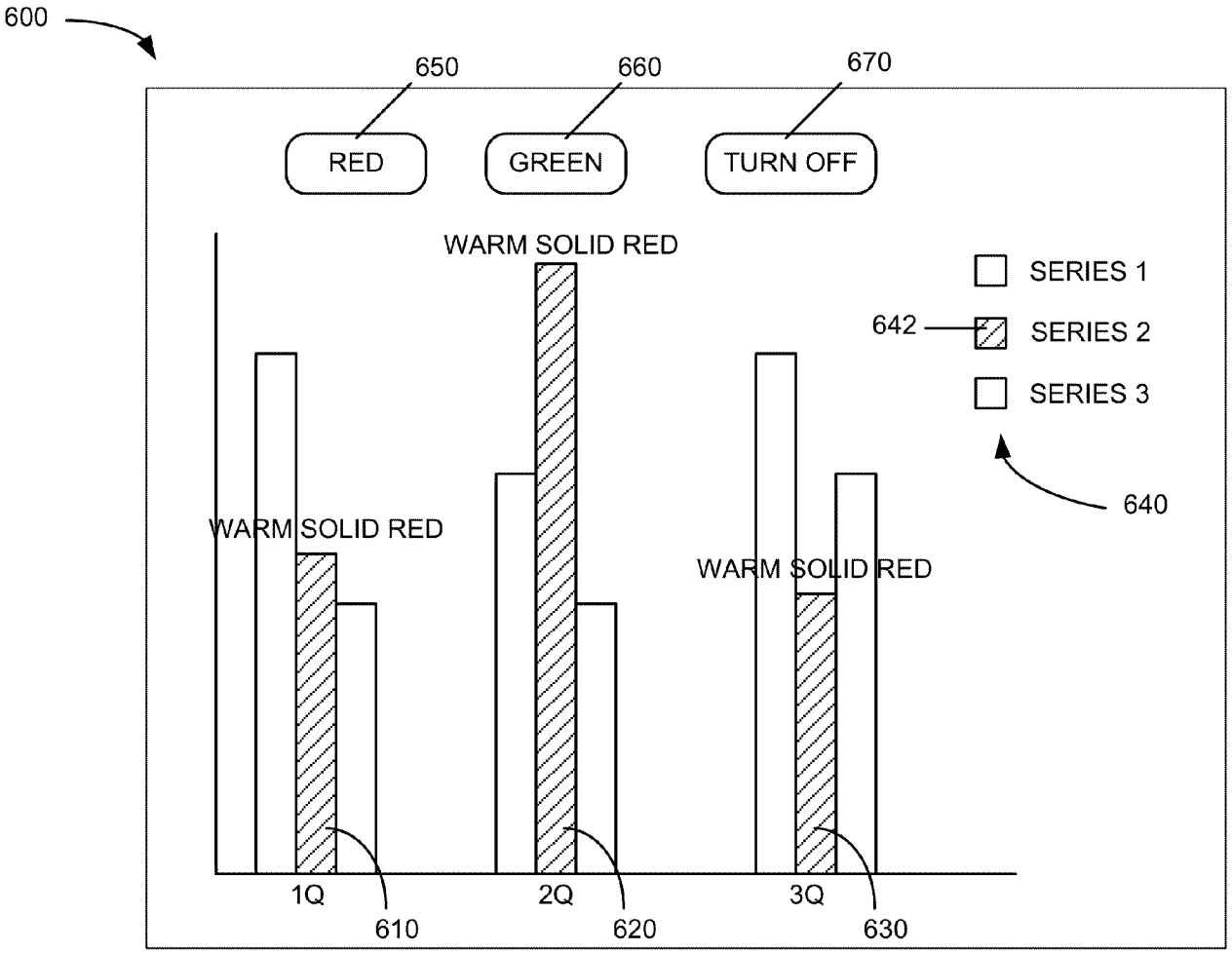
FIGS. 6A and 6B are exemplary output screens consistent with the processing of FIG. 5.

For example, assume that the user has selected a cross-hatch pattern to be used to identify objects/images having the color red. In this case, color mapping logic 340 may overlay a cross-hatch pattern over any objects or elements that include the color red and output the image for display (block 550). As an example, FIG. 6A illustrates an exemplary display 600 provided to the user via output device 250 (e.g., an LCD). In this example, display 600 may include a bar graph that displays various data in colors, such as red, green and blue. Color mapping display logic 340 may output the three bars provided in red with a cross-hatched pattern, as illustrated by the bars labeled 610, 620 and 630 in FIG. 6A. That is, bars 610, 620 and 630 included in the file provided to user device 110 will be displayed with the original color (i.e., red in this example), along with an overlaid cross-hatch pattern, as illustrated in FIG. 6A. Using the cross-hatch pattern enables the user to quickly discern the information of interest. For example, display key area 640 provided in display 600 includes information identifying keys associated with display 600. More particularly, block 642 in key area 640 included the red color and as a result, color mapping display logic 340 overlays a cross-hatch pattern over the box/description associated with box 642 to enable the user to easily discern what items are associated with "series 2." In other instances in which no color key is provided on a display, using the cross-hatching pattern for items displayed in red will also allow the user to discern images/objects that are red since the user selected the cross-hatching to correspond to the color red.

In some implementations, color mapping display logic 340 may also provide a text annotation that describes the color in a location next to the item, over the top of the item, over a portion of the item, etc. For example, referring to FIG. 6A, color mapping display logic 340 may provide text labeled "warm solid red" over top of or adjacent bars 610, 620 and 630. Color mapping logic 340 may generate this text information based on a mapping of the R, G, B pixel values to corresponding descriptive text identifying the color. The text identifying the name of a color may be stored in a table that maps R, G, B values to corresponding color names, and the table may be stored in, for example, database 330.

Display 600 may further provide "radio" style buttons 650, 660 and 670, labeled "red," "green," and "turn off," respectively. In this example, the color red may be turned on/activated so that the cross-hatching patterns is visible. If the user would no longer like to see the cross-hatching overlaid on the color red, the user may simply select/click "turn off" button 670. Color mapping display logic 340 may receive the user selection and may remove the cross-hatching pattern on display 600.

Similarly, if the user would like to select the color green for displaying via the predefined pattern, the user may click green button 660. As a result, color mapping display logic 340 may output any items or objects having the color green with the user-defined pattern overlaid on the items/objects.

Figure 6B:
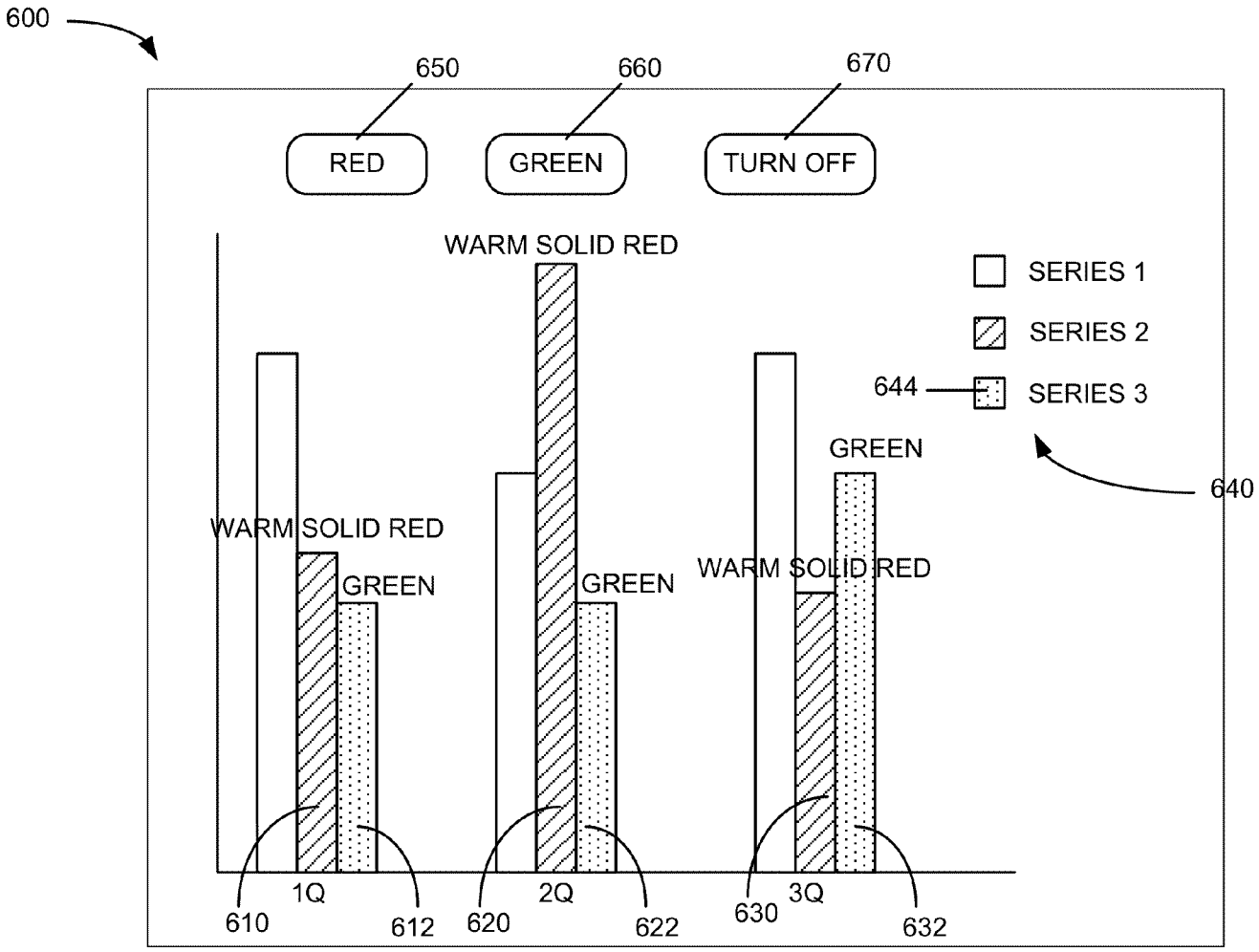

For example, FIG. 6B illustrates display 600 that include bars 612, 622 and 632 overlaid with dotted patterns. In addition, box 644 in key area 640 may be overlaid with a dotted pattern. Similar to the discussion above with respect to the color red, in some implementations, color mapping display logic 340 may also output text adjacent or over top of the items that are displayed in green. For example, referring to FIG. 6B, the word "green" may be displayed over the top portion of bars 612, 622 and 632.

In the example provided in FIGS. 6A and 6B, display 600 includes radio buttons 650 and 660 with the user-defined colors (i.e., red and green in this example), along with a turn off button 670. In other implementations, color mapping display logic 340 may output the selected colors with the overlaid patterns without inclusion of any radio style buttons, such as buttons 650-670. In such implementations, all of the identified colors stored in database 330 and corresponding patterns will be automatically provided to the user via output device 250, as illustrated by bars 610, 612, 620, 622, 630 and 632 illustrated in FIG. 6B.

In some implementations, color mapping display logic 340 may automatically remove the text annotation and/or the cross-hatching after a predetermined period of time (e.g., 5-10 seconds after the text and/or pattern is initially provided). The predetermined period of time may be user selected via user interface logic 310. Displaying the color-related information for a relatively short period of time may allow the user to discern the color information quickly, followed by removal of the color information to avoid distracting the user.

As described above, user interface logic 310 may allow a user to select patterns, words/phrases, etc., to overlay on selected colors. As also described above, in some implementations, user interface logic 310 may also allow the user to select different types of display information based on the a particular type of information to be output by user device 110.

Figure 7:
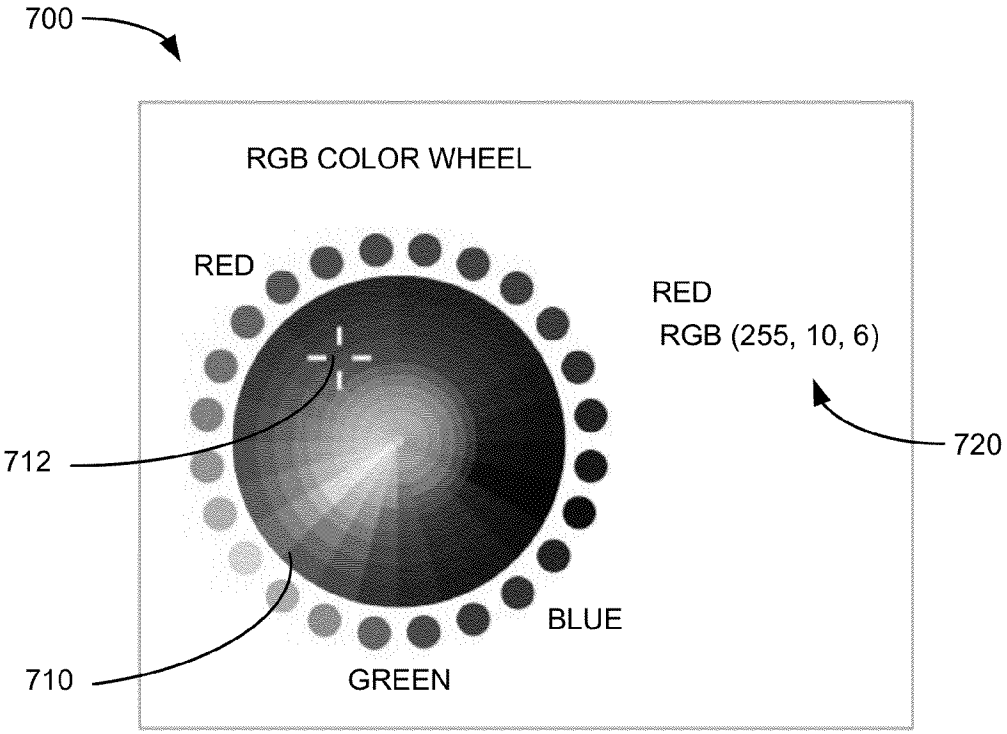
FIG. 7 is a graphical item used to provide color information in accordance with an exemplary implementation.

For example, as discussed above with respect to FIG. 4, user interface logic 310 may provide a GUI that allows the user to select a number of patterns to display over a color of interest. The GUI may also allow the user to select various graphical symbols or icons for identifying color-related information to a user. As an example, FIG. 7 illustrates a red, green and blue (RGB) color wheel 700 that may be displayed to a user to provide the user with color-related information. Referring to FIG. 7, RGB color wheel 700 may include wheel/circle 710 that includes primary colors red, green and blue, along with various intermediate colors defining various combinations of red, green and blue (e.g., dark red, warm red, pink red, blue-green, etc.) and hues, brightness levels, saturations levels, etc., associated with each of the colors.

The GUI provided by user interface logic 310 may allow the user to select the color wheel as a graphical output or icon to be used when identifying colors of interest. For example, if the user selects a particular item of interest and has selected a color wheel as the desired graphical output, color mapping display logic 340 may output color wheel 700, along with additional information identifying the color of interest. As an example, color mapping display logic 340 may output a cross-hairs symbol 712 on color wheel 710 that identifies the particular color of interest, along with text and an RGB value at area 720. The text may identify the color in words (i.e., red in this example) and the particular R, G, B pixel values (i.e., 255, 10 and 6 in this example) also identify the color of interest in accordance with the particular R, G, B value.

Figure 8:
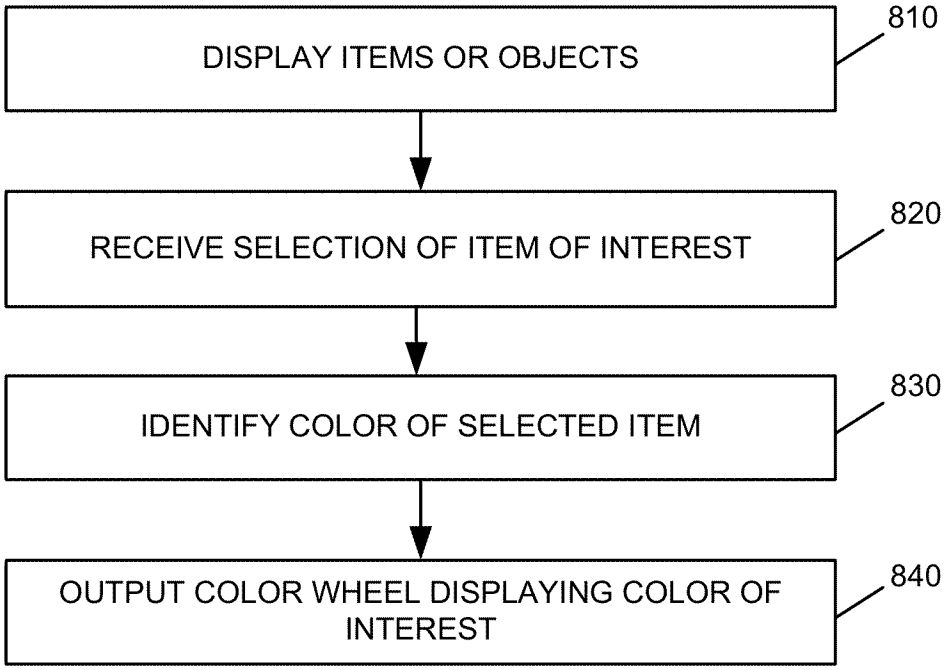
FIG. 8 is a flow diagram illustrating processing by components of FIG. 1 in accordance with another exemplary implementation.

FIG. 8 illustrates exemplary processing associated with using a color wheel to display color-related information. Processing may begin with the user accessing the Internet via user device 110 to do some shopping. For example, assume that the user is shopping for a dress via the Internet. Assume that the user has accessed a website associated with network device 130 and has downloaded a webpage that displays an item of interest (block 810). Further, assume that the user would like to identify the color of the item of interest. In this case, the user selects the item of interest by clicking on the item of interest and user interface logic 310 (FIG. 3) receives the selection (block 820).

Figure 9:
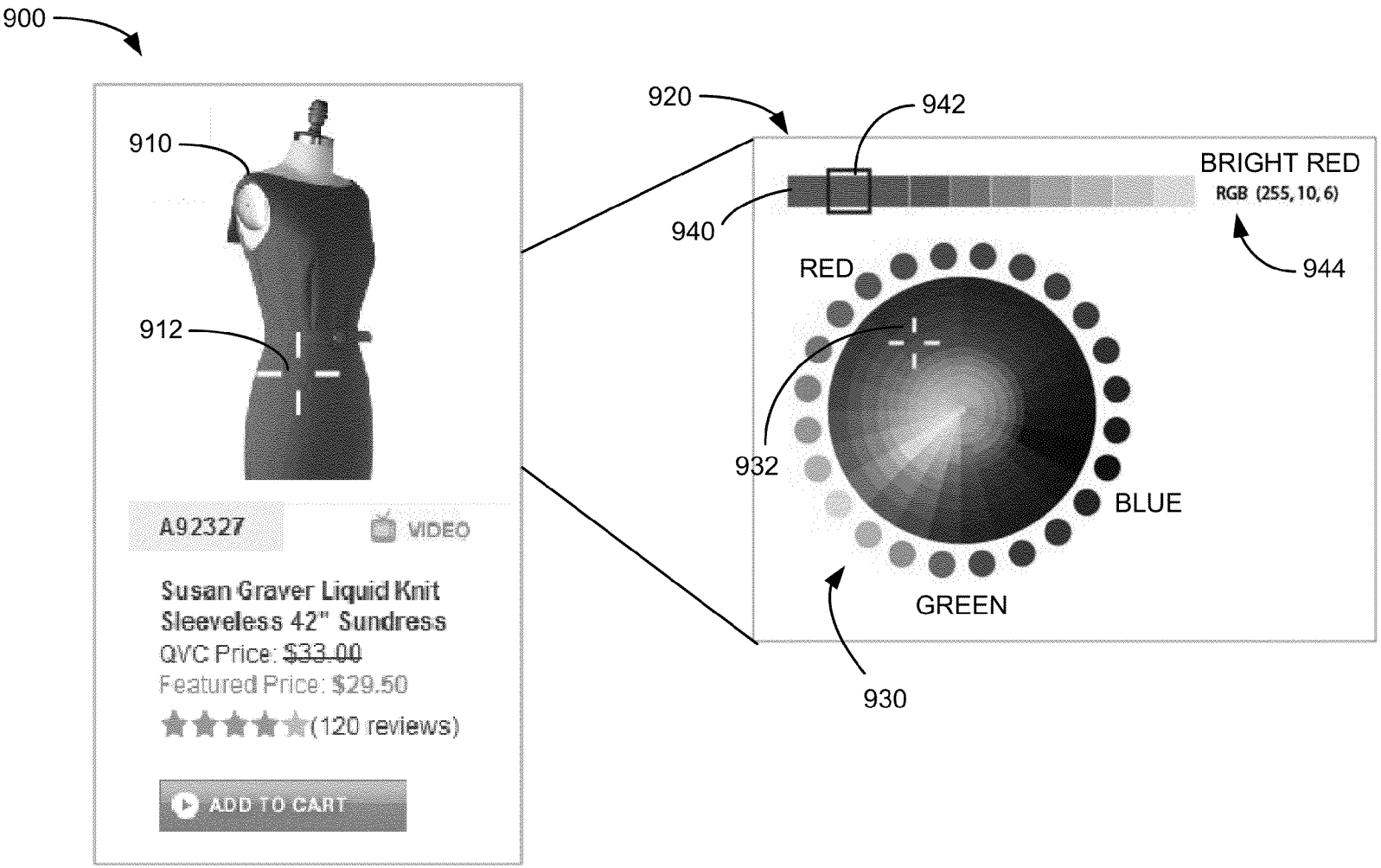
FIG. 9 is an exemplary output screen consistent with the processing of FIG. 8.

For example, assume that output device 250 is displaying web page 900 illustrated in FIG. 9. As illustrated, web page 900 includes a dress labeled 910. Further, assume that the user selects the item of interest by clicking on the item at the location identified by the cross-hairs labeled 912 in FIG. 9.

User interface logic 310 may receive the selection. Color identification logic 320 may then identify the color of the selected item/area (block 830). For example, color identification logic 320 may identify the R, G, B value associated with the selected area/item. Color mapping display logic 340 then output a color wheel identifying the corresponding color (block 840).

For example, assume that color identification logic 320 determines that the color of interest corresponds to a red color having an RGB value of 255, 10, 6. Color mapping display logic 340 may output a color wheel with this area highlighted. For example, referring to FIG. 9, color mapping display logic 340 may provide a pop-up window 920 that includes color wheel 930. In addition, color mapping display logic 340 may identify the particular color of interest on color wheel 930 via cross-hairs labeled 932. That is, cross-hairs 932 identify the location on color wheel 930 that corresponds to the color of dress 910. In some implementations, color mapping display logic 340 may also output a bar graph 940 representing a range of reds from, for example, a bright red to pink. Color mapping display logic 340 may highlight the particular red on the red color scale/bar graph via box 942. Color mapping display logic 340 may also provide the RGB value of 255, 10, 6 and text identifying "bright red" at area 944 in FIG. 9. In this manner, color map application program 300 may allow the user to select an item of interest and have color-related information provided to the user via a pop-up window output to the display.

In some implementations, color mapping display logic 340 may provide pop-up window 920 to the user for a predetermined duration of time (e.g., 10 seconds, 30 seconds, etc.) and may remove window 920 after expiration of the predetermined time. In other implementations, pop up window 920 may remain on the display until the user selects an input (e.g., a radio button) labeled "turn off" (not shown in FIG. 9).

In another implementation, user interface logic 310 may allow the user to enter a color of interest via text, and be alerted when that color (or a similar color) is displayed on user device 110. For example, assume that the user's spouse indicated to the user that she would like to buy a chartreuse colored pocket book. The user, however, may not be familiar with the chartreuse color and may enter that color via user interface logic 310. When the user is shopping for pocket books, color mapping display logic 340 may access database 330 and identify that the user would like to be alerted when the color chartreuse is displayed. In this example, assume that the user accesses a website that sells pocket books and one of the pages displays a chartreuse pocket book. In this case, color mapping logic 340 may output an alert, such as a pop-up window on output device 250, indicating that the user-selected color of chartreuse is being displayed. In addition, color mapping logic 340 may output the alert when a color that is relatively close in color (based on the R, G, B value) to the selected color of choice. This will allow color mapping logic 340 to identify items that may be close enough in color to the selected color to satisfy the user's request.

In still another implementation, user interface logic 310 may allow the user to select a color of interest via a graphical icon, such as a color wheel displayed on user device 110. For example, assume that the user's child would like a particular colored sweater for his/her birthday. User interface logic 310 may provide an R, G, B color wheel similar to color wheel 710 (FIG. 7). The child may use input device 240 (e.g., a mouse) to select the color on the R, G, B color wheel that he/she would like. For example, assume that the child selects a color corresponding to aquamarine. User interface logic 310 may receive the selection and store the selection in database 330.

Later, when the user is shopping for sweaters, color mapping display logic 340 may access database 330 and identify that the user would like to be alerted when the color aquamarine is displayed. In this example, assume that the user accesses a website that sells sweaters and one of the pages displays an aquamarine colored sweater. In this case, color mapping display logic 340 may output an alert, such as a pop-up window on output device 250, indicating that the user-selected color of aquamarine is being displayed. In addition, color mapping display logic 340 may output the alert when a color that is relatively close in color (based on the R, G, B value of the user selected color) to the selected color of choice. This will allow color mapping logic 340 to identify items that may be close enough in color to the selected color to satisfy the user's request. In this manner, a party associated with a user who is color blind or partially color blind may provide input (or the color blind person may provide input) to identify a particular color of choice in advance of a display of user device 110 outputting the color of choice. The user may then be alerted when that color of choice is displayed on output device 250.

In still another implementation, color map application program 300 may provide color information for pictures taken by camera 270 (FIG. 2). For example, assume that a user takes digital pictures via camera 270. Color mapping display logic 340 may identify colors in the digital pictures and provide color-related information when the pictures are output for display via output device 250 based on the user-defined preferences. For example, similar to the discussion above with respect to FIG. 6A, color mapping display logic 340 may overlay a cross-hatch pattern on any items having the color red.

Figure 10:
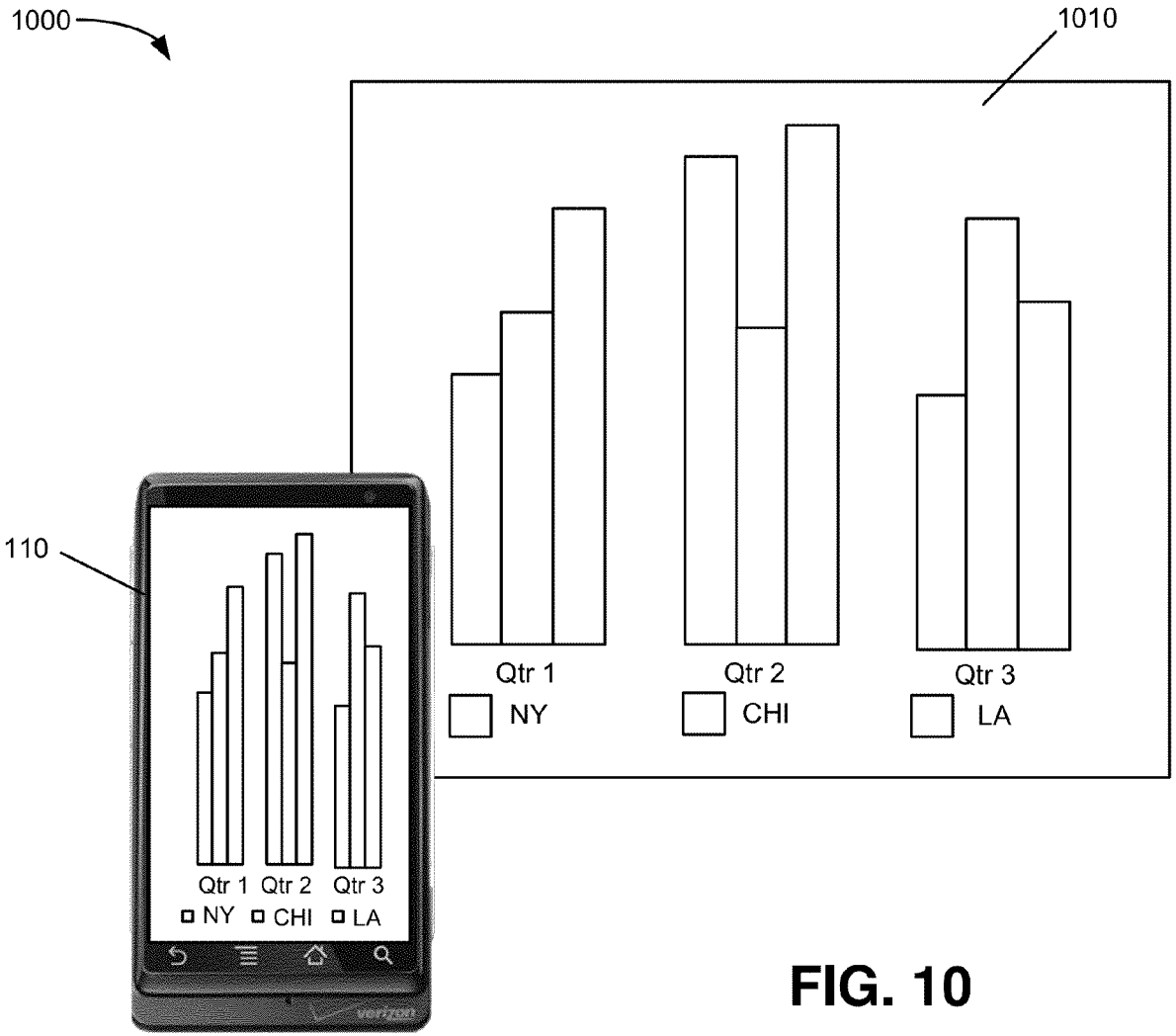
FIGS. 10 and 11 illustrate exemplary scenarios in which the color map application program of FIG. 3 may be used.

In another implementation, color map application program 300 may provide color information while user device 110 is in a camera view or video view mode. For example, assume that a user places user device 110 in camera or video mode. In this case, camera 270 may display whatever item(s) the lens of camera 270 is viewing via output device 250. As an example, suppose that the user is in a meeting and a projector is displaying information of interest on a white board in the front of the meeting room. For example, FIG. 10 illustrates a scenario 1000 in which a presentation 1010 is being given. Presentation 1010 may includes a color coded bar graph, similar to that illustrated in display 600 (FIG. 6A).

In this example, while user device 110 is in camera/video mode, the user may focus camera 270 of user device 110 on presentation 1010, such that the display of user device 110 displays presentation 1010, as illustrated in FIG. 10. Color mapping display logic 340 may identify colors in presentation 1010 and provide color-related information to the user in a similar manner as discussed above with respect to FIGS. 6A and 6B. That is, color mapping display logic 340 may overlay patterns over the user-selected colors (e.g., red and green) and/or provide text to allow the user to be able to identify the colors associated with presentation 1010. For example, similar to the discussion above with respect to FIG. 6A, color mapping display logic 340 may overlay a cross-hatch pattern on any items having the color red. In this manner, color map application program 300 may be used in real time to allow the user to view information of interest via camera 270 while user device 110 is in a camera view mode, and be able to identify particular colors that he/she may have trouble distinguishing.

Figure 11:
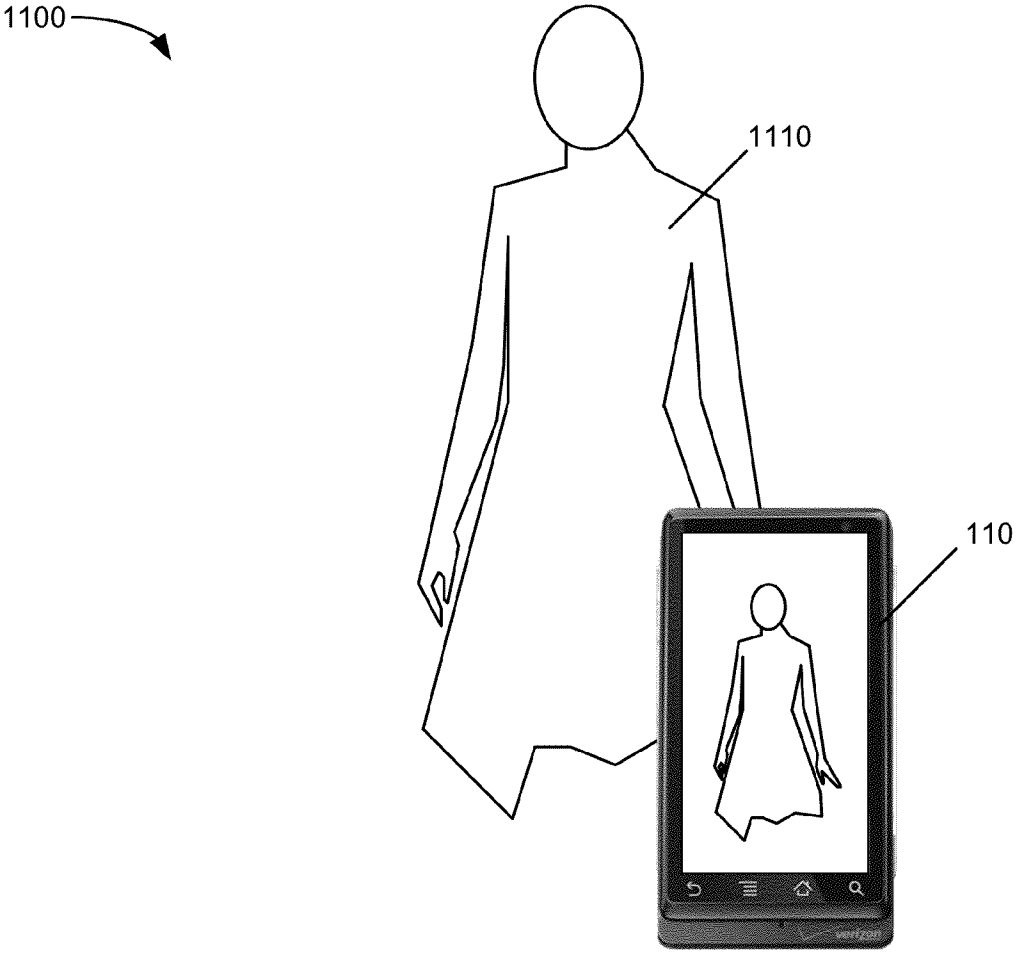

As another example, assume that the user sees a friend who is wearing a new dress and the user would like to determine the color of the dress. In this case, the user may place user device 110 in camera/video mode and focus camera 270 on his/her friend, as illustrated in FIG. 11. For example, scenario 1100 illustrates a person wearing dress 1110. In this case, the user focuses camera 270 of user device 110 on dress 1110, such that the display of user device 110 displays dress 1110, as illustrated in FIG. 11. Color mapping display logic 340 may identify the color of dress 1110 and provide color-related information to the user in a similar manner as discussed above with respect to, for example, FIG. 9. That is, color mapping display logic 340 may provide a graphical icon, such as color wheel 930, and/or text to allow the user to be able to identify the color of dress 1110.

For example, similar to the discussion above with respect to FIG. 9, color mapping display logic 340 may identify the particular color of interest on color wheel 930 via, for example, cross hairs similar to cross-hairs 932 illustrated in FIG. 9. Color mapping display logic 340 may also output a bar graph highlighting the particular color within a range of colors associated with the identified color, similar to bar graph 940 in FIG. 9. Color mapping display logic 340 may further output text identifying the color by name (e.g., pale green).

As still another example, the user may use camera 270 to identify a particular tie in her husband's closet. In this case, the user may focus camera 270 on the particular tie to identify the color of the tie. In some implementations, user interface logic 310 may store the color of the tie in database 330. When the user is later shopping for a tie, the user may know the color of the tie she wishes to purchase based on the previous identified color. In addition, the user may also use camera 270 of user device 110 to focus on a number of ties in the tie store. Color mapping display logic 340 may then alert the user when a color close to the previously stored color is displayed via output device 250. That is, when the user focuses camera 270 of user device 110 on a tie that matches the previously stored color, color mapping display logic 340 may output an alert/pop-up to the user indicating that the selected color has been identified. Therefore, color map application program 300 may be used in real time scenarios when the user would like to identify a color of a particular item of interest.

As described above, color map application program 300 may be used to display color related information for any device that outputs information to a display. For example, user device 110 may be a television or set top box that receives television programming, including three-dimensional (3D) programming, from a service provider. In this case, color map application program 300 may output any one of the color indicators described above as the user is watching the television programming to allow the user to identify particular colors. In the case of the television programming, user interface logic 310 may allow the user to set a duration of time in which the color-related information is displayed. In addition, in the case of television programming, including 3D programming, color mapping display logic 340 may overlay a pattern over the items having the particular color(s) as the color-indicator of choice in most implementations, to avoid obstructing the user's view of the scenes.

In the implementations described above, color map application program 300 may provide color-related information to a user to allow the user to quickly ascertain the color of an item that the user would otherwise not be able to identify. For example, in the examples provided above, the user had trouble discerning red and green. In other instances, the user may have trouble discerning blue and yellow, or other colors. In each case, user interface logic 310 may allow the user to select colors of interest, as well as types of display information to be used to alert the user as to displayed colors.

In addition, in some implementations, color map application program 300 may allow different users of user device 110 to store different color-related preferences. For example, color map application program 300 may require that a user provide an identifier (user identifier (ID) or password) when launching color application program 300 that allows different users of user device 110 to store different color-preference information in database 330. When a user is using user device 110, he/she will provide his her ID/password and his/her corresponding color identifiers stored in database 330 will be used to provide the user's predefined color-related identifiers via output device 250.

Further, in the implementations described above, color map application program 300 may provide color-related information to a user who is color blind or partially color blind to allow the user to quickly ascertain the color of an item that the user would otherwise not be able to identify. In other implementations, color map application program 300 may output color information to a user who is legally blind. In this case, color map application program 300 may output audio information via output device 250 (e.g., a speaker) to identify a color of interest. For example, assume that a party who is legally blind (e.g., has some vision) is shopping for a dress as described above with respect to FIG. 9. In this scenario, color mapping display logic 340 may output audio, such as, "bright red" or "bright red dress," when web page 900 is being displayed. Similarly, when user device 110 is in camera view mode, color mapping display logic 340 may output audio identifying the color of items focused on by camera 270.

Implementations described herein provide color-related information to a party who may be color blind or have difficulty distinguishing various colors. The color-related information may include one or more of text, patterns, graphical symbols or icons that allow the user to identify color information that he/she otherwise would not be able to discern. This may allow users to more fully understand information output to a display.

The foregoing description of exemplary implementations provides illustration and description, but is not intended to be exhaustive or to limit the embodiments to the precise form disclosed. Modifications and variations are possible in light of the above teachings or may be acquired from practice of the embodiments.

For example, features have been mainly described above with respect to displaying static information on a display. In some implementations, user device 110 may be streaming multi-media information (e.g., television, movies, etc.). In such implementations, color mapping display logic 340 may perform similar processing as described above. That is, color mapping display logic 340 may overlay patterns over a color of interest, provide text adjacent a color of interest, etc. However, in some implementations, color mapping display logic 340 may automatically provide the color-related information for a relatively short duration for dynamically changing output to avoid obstructing the content. In such implementations, color mapping display logic 340 may automatically provide the color-related display information based on the type of information being displayed (e.g., static information versus streaming information that is dynamically changing). In this manner, labels, icons or text will not obscure the content being displayed for more than a short period of time.

In addition, in the implementations described above, user device 110 executes map application program 300 to display color-related information. In other instances, user device 110 may receive color-related information to be output via output device 250 with the color-related identification information already included. For example, in some implementations, an external device, such as network device 130 may include map application program 300 and allow a user of user device 110 to interface with the map application program 300 stored on network device 130 to define user-related preferences, similar to that described above. In such implementations, network device 130 may transmit the color-related information to user device 110 when sending display information to user device 110. As an example, network device 130 may be associated with a home shopping website. In this case, when user device 110 downloads information of interest, the information may include a pop-up window similar to window 920 in FIG. 9, or may include other types of color information indicators (e.g., patterns overlaid on particular colors).

Further, while series of acts have been described with respect to FIGS. 4, 5, and 8, the order of the acts may be varied in other implementations. Moreover, non-dependent acts may be implemented in parallel.

It will be apparent that various features described above may be implemented in many different forms of software, firmware, and hardware in the implementations illustrated in the figures. The actual software code or specialized control hardware used to implement the various features is not limiting. Thus, the operation and behavior of the features were described without reference to the specific software code—it being understood that one of ordinary skill in the art would be able to design software and control hardware to implement the various features based on the description herein.

Further, certain portions of the invention may be implemented as "logic" that performs one or more functions. This logic may include hardware, such as one or more processors, microprocessor, application specific integrated circuits, field programmable gate arrays or other processing logic, software, or a combination of hardware and software.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A non-transitory computer-readable medium having stored thereon sequences of instructions which, when executed by at least one processor, cause the at least one processor to:

output a graphical user interface (GUI) to a display;

receive, via the GUI and from a user, a first selection identifying at least one color;

receive, via the GUI and from the user, a second selection identifying a manner in which items having the at least one color are to be displayed, wherein the manner includes at least two of providing a pattern, text, a graphical symbol or an icon;

identify a first item having a first one of the at least one color to be output to the display;

generate information associated with the first item, the generated information including text identifying the first color and the graphical symbol associated with the first color based on the second selection, wherein the graphical symbol includes a spectrum of colors and graphically identifies the color of the first item within the spectrum of colors; and output the generated information to the display.

2. The non-transitory computer-readable medium of claim 1, wherein when generating information, the instructions cause the at least one processor to generate the pattern associated with the first color to overlay on the first item.

3. The non-transitory computer-readable medium of claim 1, wherein the text identifies the color of the first item.

4. The non-transitory computer-readable medium of claim 1, wherein the receiving a first selection, via the GUI, comprises receiving information identifying a plurality of different colors, and wherein the receiving a second selection comprises receiving information identifying different manners in which each of the plurality of different colors are to be displayed.

5. The non-transitory computer-readable medium of claim 1, further including instructions for causing the at least one processor to:

output image data to the user via the display;

receive, from the user, a selection corresponding to a second item included in the image data;

identify a color of the second item;

generate display information identifying the color of the second item, based on the received second selection; and output the display information identifying the color of the second item to the display.

6. The non-transitory computer-readable medium of claim 5, wherein when outputting the display information, the instructions cause the at least one processor to:

output the display information to the display via a pop-up window.

7. The non-transitory computer-readable medium of claim 1, wherein when outputting the generated information, the instructions cause the at least one processor to:

automatically output, without selection or identification by the user of the first item via an input device, the generated information for a predetermined period of time, and remove the generated information after the predetermined period of time has expired.

8. The non-transitory computer-readable medium of claim 1, further including instructions for causing the at least one processor to:

provide, via the user interface, information to allow the user to select from a plurality of types of color-related information to be output to the display to identify items having the at least one color.

9. The non-transitory computer-readable medium of claim 8, further including instructions for causing the at least one processor to:

provide a first type of color-related information for static images output to the display, and provide a second type of color-related information for moving images output to the display, wherein the first type of color-related information is different than the second type of color-related information.

10. The non-transitory computer-readable medium of claim 1, further including instructions for causing the at least one processor to:

provide, via the GUI, a listing to allow the user to select a plurality of colors;

receiving a selection, via the user interface, identifying a second one of the plurality of colors;

identify a second item having the second color that is output to the display; and provide an indication to the user, via the display, that the second item has the second color.

11. The non-transitory computer-readable medium of claim 1, further including instructions for causing the at least one processor to:

receive image data captured by a camera or video device;

identify a color of at least one item in the image data; and automatically output an indication of the identified color of the at least one item via an output device.

12. A non-transitory computer-readable medium having stored thereon sequences of instructions which, when executed by at least one processor, cause the at least one processor to:

output a graphical user interface (GUI) to a display, the GUI allowing a user to provide information identifying a manner in which various colors are to be displayed;

receive, via the GUI and from a user, a first selection identifying at least one color;

identify a first item having a first one of the at least one color to be output to the display;

generate information associated with the first item, the generated information including text identifying the color of the first item and a graphical symbol identifying the color of the first item, wherein the graphical symbol comprises a color wheel and wherein the color wheel displays primary colors and intermediate colors and the color of the first item is identified on the color wheel; and output the generated information to a display.

13. A computer-implemented method, comprising:

outputting a graphical user interface (GUI) to a display;

receiving, via the GUI and from a user, a first selection identifying at least one color;

receiving, via the GUI and from the user, a second selection identifying a manner in which items having the at least one color are to be displayed, wherein the manner includes at least one of providing a pattern, text, a graphical symbol or an icon;

identifying a first item having a first one of the at least one color to be output to the display;

generating information associated with the first item based on the second selection, the generated information including text identifying the first color and the graphical symbol that will be used to identify the first color, wherein the graphical symbol includes a spectrum of colors and graphically identifies the color of the first item within the spectrum of colors; and outputting the generated information to the display.

14. The computer-implemented method of claim 13, wherein the generating information comprises generating the pattern associated with the first color to overlay on the first item.

15. The computer-implemented method of claim 13, wherein the text identifies the first color, the method further comprising:

inserting the text on the display at a location near or on the first item.

16. The computer-implemented method of claim 13, further comprising:

wherein the receiving a first selection comprises receiving information identifying a plurality of different colors, and wherein the receiving a second selection comprises receiving information identifying different manners in which each of the plurality of different colors are to be displayed.

17. The computer-implemented method of claim 13, further comprising:

outputting image data to the user via the display;

receiving, from the user, a selection corresponding to a second item included in the image data;

determining a color of the second item;

generating display information identifying the color of the second item based on the second selection; and outputting the display information identifying the color of the second item to the display.

18. The computer-implemented method of claim 13, further comprising:

providing, via the GUI, a listing to allow the user to select a plurality of colors;

receiving a selection, via the user interface, identifying a second one of the plurality of colors;

identifying a second item having the second color that is output to the display; and providing an indication to the user, via the display, that the second item has the second color.

19. The computer-implemented method of claim 13, further comprising:

receiving image data captured by a camera or video device;

identifying a color of at least one item in the image data; and outputting an indication of the identified color of the at least one item via the display.

20. A device, comprising:

a memory configured to store user preferences, provided by a user via a graphical user interface, associated with displaying color-related information, wherein the user preferences identify a plurality of colors and a manner in which each of the plurality of colors is to be identified; and processing logic configured to:

receive, from a user, information identifying a first one of the plurality of colors, identify a first item having the first color to be output to a display, generate information associated with the first item, based on the user preferences stored in the memory, wherein the generated information includes text identifying the first color and at least one of a graphical symbol or an icon that will be used to identify the first color, wherein the graphical symbol or icon includes a spectrum of colors and graphically identifies the color of the first item within the spectrum of colors, and output the generated information to the display.

21. The device of claim 20, further comprising:

a camera configured to capture still or moving images, wherein the processing logic is further configured to:

receive image data via the camera, identify a color of at least one item in the image data, and output an indication of the identified color of the least one item via the display based on the user preferences stored in the memory.

22. The device of claim 20, wherein the device comprises at least one of a personal computer, a laptop computer, a tablet computer, a netbook, a mobile phone, a camera, a set top box or a television.

23. The computer-implemented method of claim 13, wherein the graphical symbol comprises at least one of a color wheel that displays primary colors and intermediate colors and the color of the first item is identified on the color wheel, or a bar graph that displays a plurality of colors and the color of the first item is identified on the bar graph.

24. The device of claim 20, wherein the graphical symbol or icon comprises at least one of a color wheel that displays primary colors and intermediate colors and the color of the first item is identified on the color wheel, or a bar graph that displays a plurality of colors and the color of the first item is identified on the bar graph.

* * * * *